United States Patent [19]

Helms

[11] 4,289,252

[45] Sep. 15, 1981

[54] HERMETICALLY SEALED CONTAINER

[75] Inventor: Charles R. Helms, Malvern, Pa.

[73] Assignee: Container Corporation of America, Chicago, Ill.

[21] Appl. No.: 170,827

[22] Filed: Jul. 21, 1980

[51] Int. Cl.[3] ..... B65D 39/00

[52] U.S. Cl. ..... 220/308; 220/306; 220/380; 215/321; 215/DIG. 1

[58] Field of Search ..... 215/321, DIG. 1, 317; 220/306, 308, 380

[56] References Cited

U.S. PATENT DOCUMENTS

| | | | |
|---|---|---|---|
| 2,711,840 | 6/1955 | Gits et al. | 215/DIG. 1 |
| 3,458,079 | 7/1969 | Gasbarra | 220/308 X |
| 3,880,288 | 4/1975 | Hunter | 220/306 X |

*Primary Examiner*—George T. Hall

*Attorney, Agent, or Firm*—Richard W. Carpenter

[57] ABSTRACT

A container body and lid arrangement wherein the body rim is of harder less flexible material than that of the lid and has a sharp peripheral edge adapted to bite into the material of the lid and effect a seal therebetween.

8 Claims, 7 Drawing Figures

HERMETICALLY SEALED CONTAINER

SUMMARY OF THE INVENTION

The invention relates to containers of the type having plastic rims and plastic lids or caps adapted to fit in a manner that will form a hermetic seal therebetween.

It is an object of the invention to provide, in such an arrangement, a container rim of hard, non-flexible material having a sharp pointed lip or bead adapted to bite into and effect a hermetic seal with the rim of a lid formed of a soft, flexible material.

These and other objects of the invention will be apparent from an examination of the following description and drawings.

THE DRAWINGS

If will be understood that, for purposes of clarity, certain elements may have been intentionally omitted from certain views where they are believed to be illustrated to better advantage in other views.

THE DESCRIPTION

Figure 1:
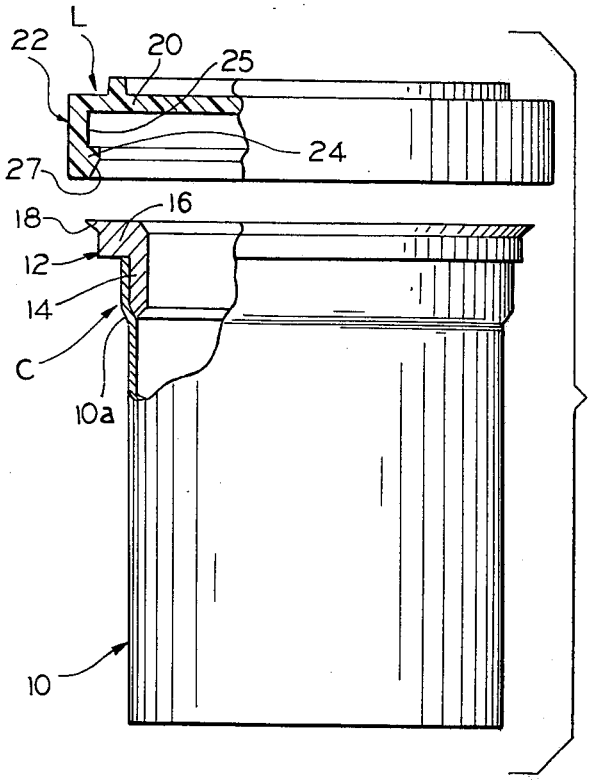
FIG. 1 is a side elevation, partly in section of a container body and lid embodying features of the invention.

Referring now to the drawings for a better understanding of the invention, it will be seen that there is shown in FIG. 1 a container indicated generally at C and a closure or lid indicated generally at L, which embody features of the invention.

Container C includes a tubular body 10 which may be formed of paperboard, plastic, or other material. Body 10 includes an offset upper marginal portion 10*a* which is adapted to be secured to a rim 12 which is formed from a relatively hard, non-flexible plastic material.

Although the structure disclosed in the drawings and referred to in the description is a tubular container of cylindrical shape, it is to be understood that the invention is equally applicable to a container and lid wherein the configuration is other than cylindrical or round, such as rectangular or hexagonal.

Rim 12 includes a depending annular skirt 14 which is adapted to be received and secured within the upper marginal portion 10*a* of container body 10.

Rim 12 also includes an integral annular flange 16 which projects radially outward beyond skirt 14. In the embodiment illustrated in FIG. 1, flange 16 has an annular sealing bead 18 located at its upper extremity. Bead 18 projects outwardly beyond the remaining outer surface of flange 16 and presents a sharp or pointed edge which is adapted to effect a hermetic seal with the lid L in a manner hereinafter described.

Lid L includes a horizontal top wall 20 having a cylindrical rim 22 depending therefrom which includes a radially inwardly projecting flange 24 located at the lower extremity thereof and forming with the rim and inner surface of the top wall an annular groove or channel 25. Flange 24 presents a chamfered inner surface 27 to accommodate insertion of the lid L over the top of container rim 12 and particularly bead 18.

Figure 2:
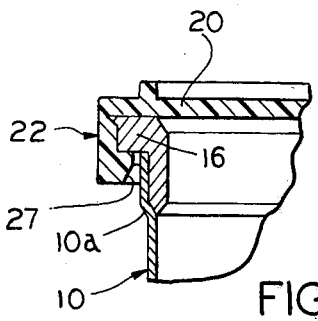
FIG. 2 is a fragmentary vertical section of the structure illustrated in FIG. 1, but with the container body and lid shown in engaged sealed position.

Thus when the lid has been snapped over the container as illustrated in FIG. 2, flange 16 of the container rim is snugly received within channel 25 of the lid and sealing bead 18 is forced to bite or dig into the inner surface of lid rim 22 to effect a hermetic seal between the container and the lid.

Figure 4:
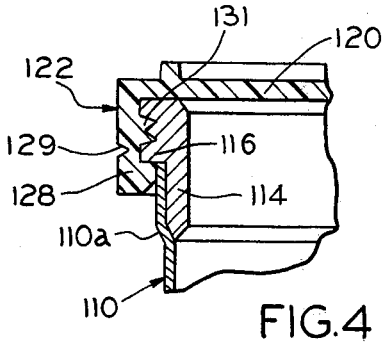
FIGS. 3 and 4 are views similar to FIGS. 1 and 2, respectively, but illustrating a modified form of the invention.
Figure 3:
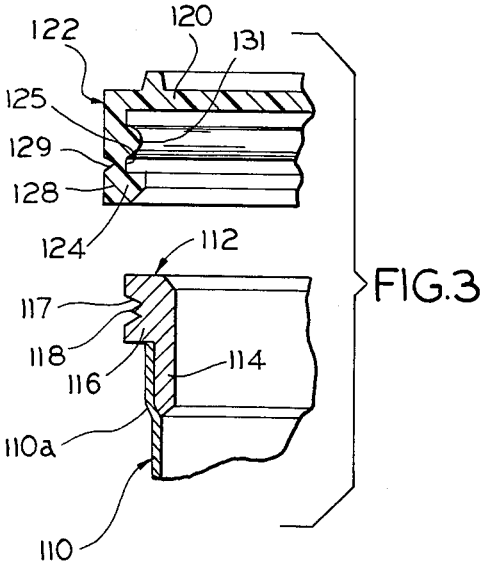

Referring now to FIGS. 3 and 4 it will be seen that a slightly modified form of the invention is disclosed. Similar numerals have been used to designate corresponding portions of the structure. The structure of FIG. 3 differs from that of FIG. 1 in two respects. First it will be noted that the sealing bead 118 of the container rim is located intermediate the upper and lower extremities of the rim flange 16 and is recessed slightly from the outer surface of the flange. Also the lid rim 22 includes an annular projection or ring 131 which extends inwardly from rim 122 within the channel 125. Thus when the lid is snapped over the container rim as illustrated in FIG. 4, sealing bead 118 is able to bite or dig into ring 131 to effect a hermetic seal between the container and lid.

A second feature of the embodiment illustrated in FIGS. 3 and 4 is that the lower portion of the container lid 128, which portion includes the flange 124, is a removable section separated from the remaining or upper portion of the lid by a weakening line or groove 129. When the container is initially opened, section 128 of the lid is torn or pealed off to facilitate removal of the lid.

Figure 6:
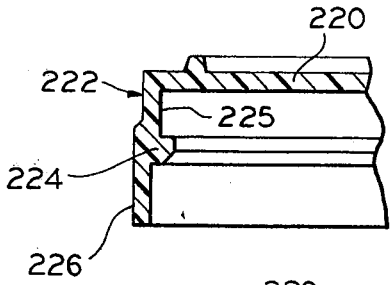
FIG. 6 is a vertical section of the lid structure illustrated in FIG. 5.
Figure 7:
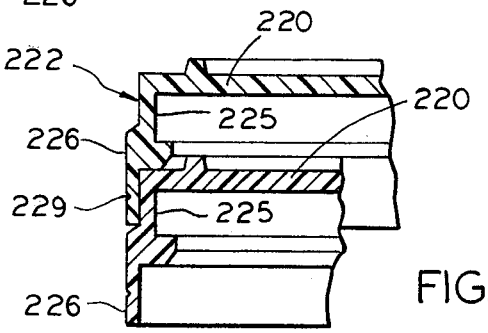
FIG. 7 is a view similar to that of FIG. 6, but showing a pair of similar lids in nesting relation.
Figure 5:
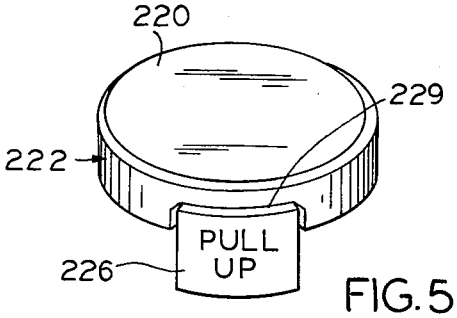
FIG. 5 is a perspective view of a modified form of the lid illustrated in the other views.

Turning now to FIGS. 5, 6 and 7, a slightly modified form of the invention is illustrated. In this embodiment lid rim 222 includes a removable pull tab 226 which is secured to the remaining portion of the lid along a V-shaped line of weakness or groove 229. Thus when the pull tab is lifted and detached from the remainder of the lid, the tensile strength in the rim and the lid is weakened and removal of the lid from the container is facilitated.

As best seen in FIGS. 6 and 7, pull tab 226 projects outwardly from the remaining outer surface of rim 222 to permit stacking of similar lids as illustrated in FIG. 7.

Thus it will be appreciated that the invention includes several embodiments, each of which is of relatively simple design and construction but yet creates a hermetic seal between a relatively hard, rigid container rim and a relatively soft, flexible lid rim, by providing a sharp or pointed sealing bead on the container rim which bites or digs into the softer, more flexible material of the container lid or closure.

I claim:

1. In a hermetically sealable body and lid arrangement for a container, the combination of:

(a) a lid formed of relatively soft, flexible, molded plastic material and including:
  (i) a top wall;
  (ii) an annular rim depending from said top wall;
  (iii) an annular flange extending radially inward from a lower portion of said rim and defining therewith and with said top wall an annular recess;

(b) a tubular container body open at the top;

(c) a container rim formed of relatively hard, non-flexible, plastic material and including:

(i) an annular skirt secured within an upper marginal portion of said body;

(ii) an annular flange extending radially outward from an upper portion of said rim for receipt with the recess of said lid;

(iii) an annular sealing bead projecting radially outward from said flange and presenting a pointed sharp peripheral edge adapted to dig into the rim of said lid to effect a seal between said lid and container.

2. An arrangement according to claim 1, wherein said container rim sealing bead is located at the upper extremity of said container rim flange and projects radially outward therefrom beyond the remaining outer surface thereof.

3. An arrangement according to claim 1, wherein said container sealing bead is located intermediate the upper and lower extremities of said container rim flange.

4. An arrangement according to claim 3, wherein said container rim sealing bead is offset radially inward from the outer surface of said container rim flange.

5. An arrangement according to claim 4, wherein said container rim flange presents an annular ring projecting radially inward therefrom for engagement with said container in sealing bead.

6. An arrangement according to claim 1, wherein a lower portion of said lid rim is detachably secured to the remaining portion of said lid rim and separated therefrom by an annular line of weakness.

7. An arrangement according to claim 1, wherein said lid rim includes a detachable portion which may be removed to reduce the circumferencial tensile strength in said lid rim to facilitate removal of the lid from the container.

8. An arrangement according to claim 7, wherein said detachable portion extends radially outward from the remaining portion of the lid rim to accommodate nesting of similar lids.

* * * * *